US007410347B2

(12) United States Patent
Radue

(10) Patent No.: US 7,410,347 B2
(45) **Date of Patent: *Aug. 12, 2008**

(54) RECIPROCATING FLUID PUMP ASSEMBLY EMPLOYING REVERSING POLARITY MOTOR

(75) Inventor: Martin Radue, Kenosha, WI (US)

(73) Assignee: BRP US Inc., Sturtevant, WI (US)

( * ) Notice: Subject to any disclaimer, the term of this patent is extended or adjusted under 35 U.S.C. 154(b) by 483 days.

This patent is subject to a terminal disclaimer.

(21) Appl. No.: 11/196,379

(22) Filed: Aug. 4, 2005

(65) Prior Publication Data

US 2005/0276706 A1 Dec. 15, 2005

Related U.S. Application Data

(63) Continuation of application No. 09/528,766, filed on Mar. 17, 2000, now Pat. No. 6,966,760.

(51) Int. Cl.
*F04B 17/04* (2006.01)
*F04B 39/10* (2006.01)
*F02M 37/04* (2006.01)

(52) U.S. Cl. ..... 417/417; 417/549; 417/570; 123/499

(58) Field of Classification Search ..... 417/417, 417/549, 570; 123/497, 498
See application file for complete search history.

(56) References Cited

U.S. PATENT DOCUMENTS

| | | | |
|---|---|---|---|
| 1,908,092 | A | 5/1933 | Whitted |
| 2,934,256 | A | 4/1960 | Lenning |
| 3,386,622 | A | 6/1968 | Cox et al. |
| 3,606,595 | A | 9/1971 | Hideo |
| 3,642,385 | A | 2/1972 | McMahon |
| 3,781,140 | A | 12/1973 | Gladden |
| 4,116,591 | A | 9/1978 | Mardell |
| 4,219,863 | A | 8/1980 | Takeshima |

(Continued)

FOREIGN PATENT DOCUMENTS

| | | |
|---|---|---|
| DE | 3442325 | 6/1985 |
| DE | 19924485 | 12/1999 |
| GB | 1504873 | 3/1978 |
| GB | 2306580 | 7/1997 |
| JP | 56-159575 | 12/1981 |

(Continued)

OTHER PUBLICATIONS

Translation of German Patent DE19924485A1.

(Continued)

*Primary Examiner*—Charles G Freay
(74) *Attorney, Agent, or Firm*—Osler, Hoskin & Harcourt LLP

(57) ABSTRACT

A reciprocating pump includes a drive section and a pump section. The drive section has a reciprocating coil assembly to which alternating polarity control signals are applied during operation. A permanent magnet structure of the drive section creates a magnetic flux field which interacts with an electromagnetic field produced during application of the control signals to the coil. Depending upon the polarity of the control signals applied to the coil, the coil is driven in one of two directions of movement. A drive member transfers movement of the coil to a pump element which reciprocates with the coil to draw fluid into a pump chamber and expel the fluid during each pump cycle. The pump is particularly well suited to cyclic pumping applications, such as fuel injection systems for internal combustion engines.

30 Claims, 5 Drawing Sheets

U.S. PATENT DOCUMENTS

| | | | | |
|---|---|---|---|---|
| 4,266,523 | A | 5/1981 | Brinkman | |
| 4,300,873 | A | 11/1981 | Mowbray et al. | |
| 4,308,475 | A | 12/1981 | Haeck | |
| 4,345,565 | A | 8/1982 | Bottoms | |
| 4,533,890 | A | 8/1985 | Patel | |
| 4,616,930 | A | 10/1986 | Martin | |
| 4,787,823 | A | 11/1988 | Hultman | |
| 4,829,947 | A | 5/1989 | Lequesne | |
| 4,940,035 | A | 7/1990 | Waring | |
| 4,945,269 | A * | 7/1990 | Kamm | 310/15 |
| 5,032,772 | A | 7/1991 | Gully et al. | |
| 5,064,353 | A | 11/1991 | Tsukahara | |
| 5,080,079 | A | 1/1992 | Yoshida et al. | |
| 5,104,298 | A | 4/1992 | Takahashi et al. | |
| 5,104,299 | A | 4/1992 | Mizuno et al. | |
| 5,161,779 | A | 11/1992 | Graner et al. | |
| 5,334,910 | A | 8/1994 | Karsten et al. | |
| 5,351,893 | A | 10/1994 | Young | |
| 5,434,549 | A | 7/1995 | Hirabayashi et al. | |
| 5,469,828 | A | 11/1995 | Heimberg et al. | |
| 5,472,323 | A | 12/1995 | Hirabayashi et al. | |
| 5,520,154 | A | 5/1996 | Heimberg et al. | |
| 5,540,206 | A | 7/1996 | Heimberg | |
| 5,630,401 | A | 5/1997 | Binversie et al. | |
| 5,639,062 | A * | 6/1997 | Irgens et al. | 251/120 |
| 5,779,454 | A | 7/1998 | Binversie et al. | |
| 5,960,766 | A | 10/1999 | Hellmich | |
| 5,961,045 | A | 10/1999 | Coldren et al. | |
| 5,996,548 | A | 12/1999 | Hellmich | |
| 6,024,071 | A | 2/2000 | Heimberg et al. | |
| 6,024,298 | A * | 2/2000 | Kelly | 239/127 |
| 6,109,549 | A | 8/2000 | Radue et al. | |
| 6,161,525 | A | 12/2000 | Ficht | |
| 6,188,561 | B1 | 2/2001 | Heimberg | |
| 6,290,308 | B1 | 9/2001 | Zitzelsberger | |
| 6,398,511 | B1 | 6/2002 | French et al. | |
| 6,401,696 | B1 | 6/2002 | Heimberg | |
| 6,607,361 | B1 | 8/2003 | Kotter et al. | |
| 6,966,760 | B1 * | 11/2005 | Radue | 417/416 |

FOREIGN PATENT DOCUMENTS

| | | |
|---|---|---|
| JP | 56-159576 | 12/1981 |
| JP | 61-200386 | 9/1986 |
| JP | 06-38486 | 2/1994 |
| JP | 06-185456 | 7/1994 |
| JP | 06-200869 | 7/1994 |
| JP | 06-346833 | 12/1994 |
| JP | 07-27041 | 1/1995 |
| JP | 07109975 | 4/1995 |
| JP | 07-259729 | 10/1995 |
| JP | 08-116658 | 5/1996 |
| JP | 2000-170646 | 6/2000 |
| JP | 2000-299971 | 10/2000 |

OTHER PUBLICATIONS

English Abstract of JP2000-299971.
Machine Translation of JP2000-299971.
English Abstract of JP2000-170646.
English Abstract of JP08-116658.
Machine Translation of JP08-116658.
English Abstract of JP07-259729.
Machine Translation of JP07-259729.
English Abstract of JP06-185456.
Machine Translation of JP06-185456.
English Abstract of JP06-346833.
Machine Translation of JP06-346833.
English Abstract of JP06-200869.
Machine Translation of JP06-200869.
English Abstract of JP06-38486.
Machine Transtlation of JP06-38486.
English Abstract of JP61-200386.
English Listing of Numerical References for the Figures of JP61-200386.
English Abstract of JP56-159575.
English Listing of Numerical References for the Figures of JP56-159575.
English Abstract of JP56-159576.
English Listing of Numerical References for the Figures of JP56-159576.
English Abstract of JP07-27041.
Machine Translation of JP07-27041.

* cited by examiner

RECIPROCATING FLUID PUMP ASSEMBLY EMPLOYING REVERSING POLARITY MOTOR

This application claims priority from U.S. is a continuation of U.S. application Ser. No. 09/528,766 filed Mar. 17, 2000, which is incorporated herein by reference.

BACKGROUND OF THE INVENTION

1. Field of the Invention

The present invention relates generally to the field of electrically-driven reciprocating pumps. More particularly, the invention relates to a pump which is particularly well suited for use as a fuel pump, driven by a solenoid assembly employing a permanent magnet and a solenoid coil to produce pressure variations in a pump section and thereby to draw into and express from the pump section a fluid, such as a fuel being pumped. The invention also relates to a fuel injector assembly employing such a pump.

2. Description of the Related Art

A wide range of pumps have been developed for displacing fluids under pressure produced by electrical drives. For example, in certain fuel injection systems, fuel is displaced via a reciprocating pump assembly which is driven by electric current supplied from a source, typically a vehicle electrical system. In one fuel pump design of this type, a reluctance gap coil is positioned in a solenoid housing, and an armature is mounted movably within the housing and secured to a guide tube. The solenoid coil may be energized to force displacement of the armature toward the reluctance gap in a magnetic circuit defined around the solenoid coil. The guide tube moves with the armature, entering and withdrawing from a pump section. By reciprocal movement of the guide tube into and out of the pump section, fluid is drawn into the pump section and expressed from the pump section during operation.

In pumps of the type described above, the armature and guide tube are typically returned to their original position under the influence of one or more biasing springs. Where a fuel injection nozzle is connected to the pump, an additional biasing spring may be used to return the injection nozzle to its original position. Upon interruption of energizing current to the coil, the combination of biasing springs then forces the entire movable assembly to its original position. The cycle time of the resulting device is the sum of the time required for the pressurization stroke during energization of the solenoid coil, and the time required for returning the armature and guide to the original position for the next pressure stroke.

Where such pumps are employed in demanding applications, such as for supplying fuel to combustion chambers of an internal combustion engine, cycle times can be extremely rapid. Moreover, repeatability and precision in beginning and ending of pump stroke cycles can be important in optimizing the performance of the engine under varying operating conditions. While the cycle time may be reduced by providing stronger springs for returning the reciprocating assembly to the initial position, such springs have the adverse effect of opposing forces exerted on the reciprocating assembly by energization of the solenoid. Such forces must therefore be overcome by correspondingly increased forces created during energization of the solenoid. At some point, however, increased current levels required for such forces become undesirable due to the limits of the electrical components, and additional heating produced by electrical losses.

There is a need, therefore, for an improved technique for pumping fluids in a linearly reciprocating fluid pump. There is a particular need for an improved technique for providing rapid cycle times in fluid pumps, such as fuel pumps without substantially increasing the forces and current demands of electrical driving components.

SUMMARY OF THE INVENTION

The present invention provides a novel technique for pumping fluids in a reciprocating pump arrangement designed to respond to these needs. The technique is particularly well suited for use in fuel delivery systems, such as in direct, in chamber fuel injection. However, the technique is in no way limited to such applications, and may be employed in a wide range of technical fields. The pumping drive system offers significant advantages over known arrangements, including a reduction in cycle times, controllability of initial positions of a reciprocating assembly, controllability of stroke of a reciprocating assembly, and thereby of displacement per cycle, and so forth.

The technique is based upon a drive system employing at least one permanent magnet and at least one coil assembly. The coil assembly is energized cyclically to produce reciprocating motion of a drive member, which may be coupled directly to the coil. The drive member may extend into a pumping section, and cause variations in fluid pressure by intrusion into and withdrawal from the pumping section during its reciprocal movement. Valves, such as check valves, within the pumping section are actuated by the variations in pressure, permitting fluid to be drawn into the pumping section and expressed therefrom.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
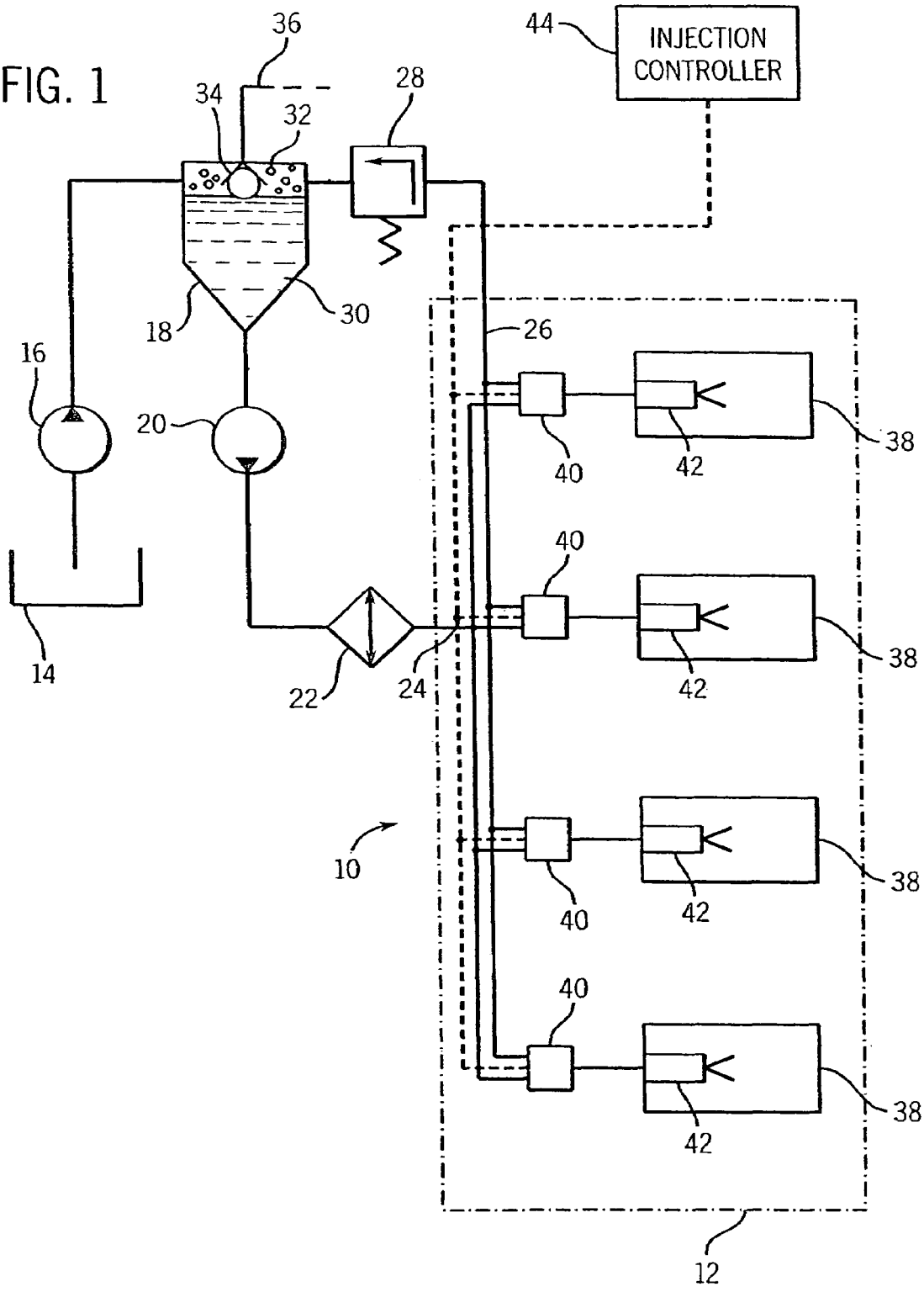
FIG. 1 is a diagrammatical representation of a series of fluid pump assemblies applied to inject fuel into an internal combustion engine.

Turning now to the drawings and referring first to FIG. 1, a fuel injection system 10 is illustrated diagrammatically, including a series of pumps for displacing fuel under pressure in an internal combustion engine 12. While the fluid pumps of the present technique may be employed in a wide variety of settings, they are particularly well suited to fuel injection systems in which relatively small quantities of fuel are pressurized cyclically to inject the fuel into combustion chambers of an engine as a function of the engine demands. The pumps may be employed with individual combustion chambers as in the illustrated embodiment, or may be associated in various ways to pressurize quantities of fuel, as in a fuel rail, feed manifold, and so forth. Even more generally, the present pumping technique may be employed in settings other than fuel injection, such as for displacing fluids under pressure in response to electrical control signals used to energize coils of a drive assembly, as described below.

In the embodiment shown in FIG. 1, the fuel injection system 10 includes a fuel reservoir 14, such as a tank for containing a reserve of liquid fuel. A first pump 16 draws the fuel from the reservoir, and delivers the fuel to a separator 18. While the system may function adequately without a separator 18, in the illustrated embodiment, separator 18 serves to insure that the fuel injection system downstream receives liquid fuel, as opposed to mixed phase fuel. A second pump 20 draws the liquid fuel from separator 18 and delivers the fuel, through a cooler 22, to a feed or inlet manifold 24. Cooler 22 may be any suitable type of fluid cooler, including both air and liquid heater exchangers, radiators, and so forth.

Fuel from the feed manifold 24 is available for injection into combustion chambers of engine 12, as described more fully below. A return manifold 26 is provided for recirculating fluid not injected into the combustion chambers of the engine. In the illustrated embodiment a pressure regulating valve 28 is placed in series in the return manifold line 26 for maintaining a desired pressure within the return manifold. Fluid returned via the pressure regulating valve 28 is recirculated into the separator 18 where the fuel collects in liquid phase as illustrated at reference numeral 30. Gaseous phase components of the fuel, designated by referenced numeral 32 in FIG. 1, may rise from the fuel surface and, depending upon the level of liquid fuel within the separator, may be allowed to escape via a float valve 34. A vent 36 is provided for permitting the escape of gaseous components, such as for repressurization, recirculation, and so forth.

Engine 12 includes a series of combustion chambers or cylinders 38 for driving an output shaft (not shown) in rotation. As will be appreciated by those skilled in the art, depending upon the engine design, pistons (not shown) are driven in a reciprocating fashion within each combustion chamber in response to ignition of fuel within the combustion chamber. The stroke of the piston within the chamber will permit fresh air for subsequent combustion cycles to be admitted into the chamber, while scavenging combustion products from the chamber. While the present embodiment employs a straightforward two-stroke engine design, the pumps in accordance with the present technique may be adapted for a wide variety of applications and engine designs, including other than two-stroke engines and cycles.

In the illustrated embodiment, a reciprocating pump 40 is associated with each combustion chamber, drawing pressurized fuel from the feed manifold 24, and further pressurizing the fuel for injection into the respective combustion chamber. A nozzle 42 is provided for atomizing the pressurized fuel downstream of each reciprocating pump 40. While the present technique is not intended to be limited to any particular injection system or injection scheme, in the illustrated embodiment a pressure pulse created in the liquid fuel forces a fuel spray to be formed at the mouth or outlet of the nozzle, for direct, in-cylinder injection. The operation of reciprocating pumps 40 is controlled by an injection controller 44. Injection controller 44, which will typically include a programmed microprocessor or other digital processing circuitry, and memory for storing a routine employed in providing control signals to the pumps, applies energizing signals to the pumps to cause their reciprocation in any one of a wide variety of manners as described more fully below.

Figure 2:
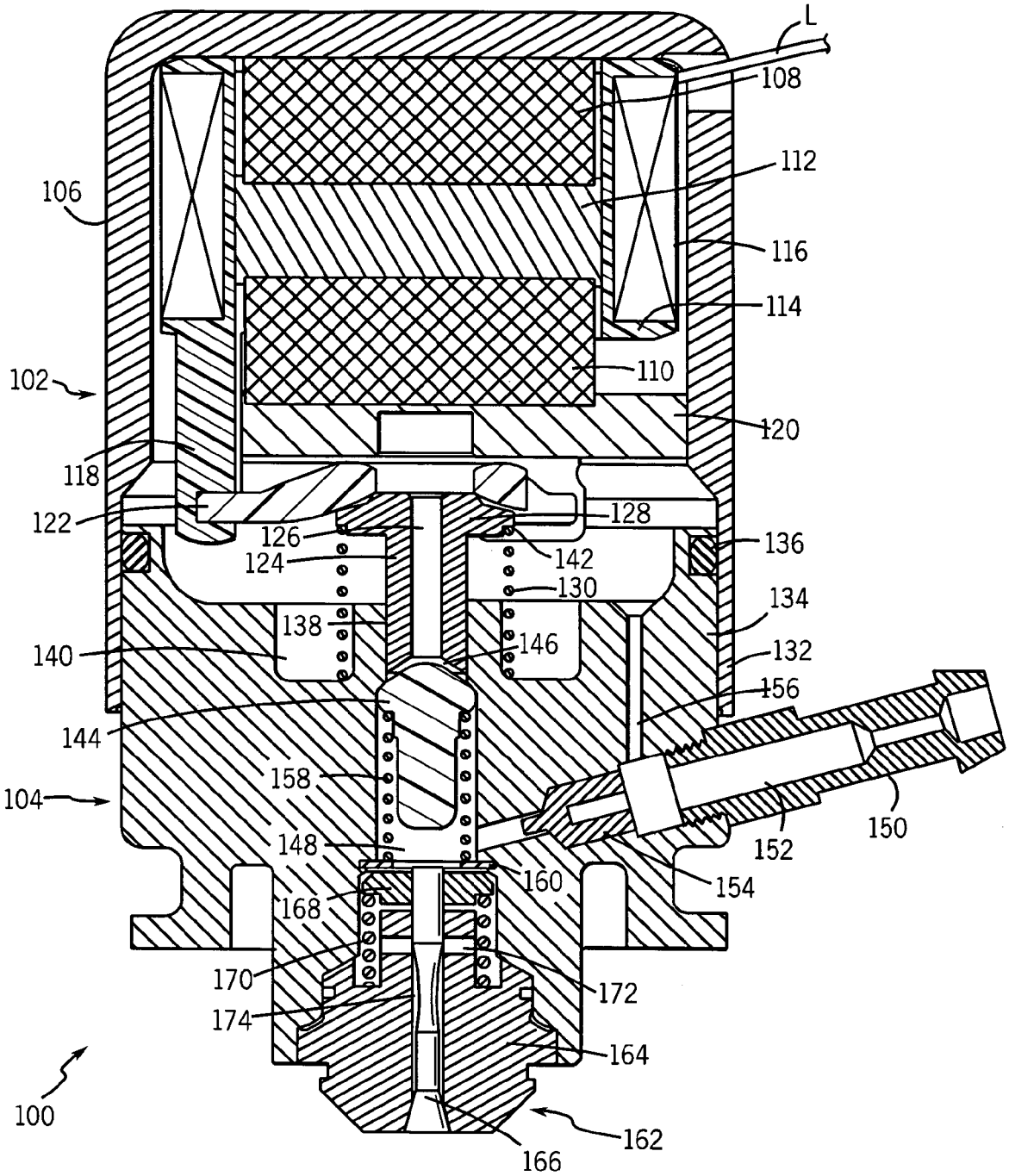
FIG. 2 is a partial sectional view of an exemplary pump in accordance with aspects of the present technique for use in displacing fluid under pressure, such as for fuel injection into a chamber of an internal combustion engine as shown in FIG. 1.
Figure 3:
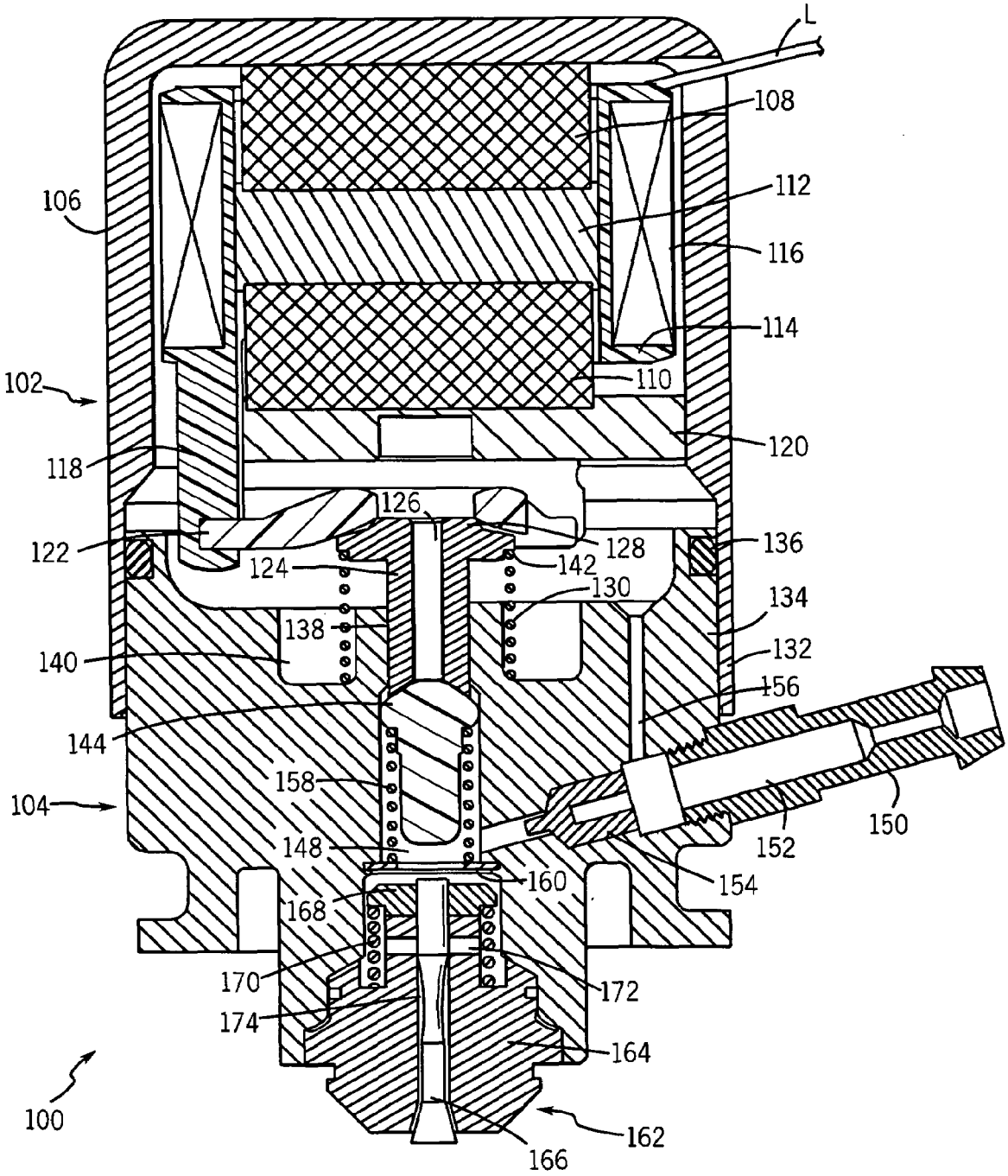
FIG. 3 is a partial sectional view of the pump illustrated in FIG. 2 energized during a pumping phase of operation.

An exemplary reciprocating pump assembly, such as for use in a fuel injection system of the type illustrated in FIG. 1, is shown in FIGS. 2 and 3. Specifically, FIG. 2 illustrates a pump and nozzle assembly 100 which incorporates a pump driven in accordance with the present techniques. Assembly 100 essentially comprises a drive section 102 and a pump section 104. The drive section is designed to cause reciprocating pumping action within the pump section in response to application of reversing polarity control signals applied to an actuating coil of the drive section as described in greater detail below. The characteristics of the output of the pumping section may thus be manipulated by altering the waveform of the alternating polarity signal applied to the drive section. In the presently contemplated embodiment, the pump and nozzle assembly 100 illustrated in FIG. 2 is particularly well suited to application in an internal combustion engine, as in the components illustrated in FIG. 1 as pumps 40. Moreover, in the embodiment illustrated in FIG. 2, a nozzle assembly is installed directly at an outlet of the pump section, such that the pump 40 of FIG. 1 and the nozzle 42 are incorporated into a single assembly or unit. As indicated above, in appropriate applications, the pump illustrated in FIG. 2 may be separated from the nozzle, such as for application of fluid under pressure to a manifold, fuel rail, or other downstream component.

As illustrated in FIG. 2, drive section 102 includes a housing 106 designed to sealingly receive the drive section components and support them during operation. The drive section further includes at least one permanent magnet 108, and in the preferred embodiment illustrated, a pair of permanent magnets 108 and 110. The permanent magnets are separated from one another and disposed adjacent to a central core 112 made of a material which is capable of conducting magnetic flux, such as a ferromagnetic material. A coil bobbin 114 is disposed about permanent magnets 108 and 110, and core 112. While magnets 108 and 110, and core 112 are fixedly supported within housing 106, bobbin 114 is free to slide longitudinally with respect to these components. That is, bobbin 114 is centered around core 112, and may slide with respect to the core upwardly and downwardly in the orientation shown in FIG. 2. A coil 116 is wound within bobbin 114 and free ends of the coil are coupled to leads L for receiving energizing control signals, such as from an injection controller 44, as illustrated in FIG. 1. Bobbin 114 further includes an extension 118 which protrudes from the region of the bobbin in which the coil is installed for driving the pump section as described below. Although one such extension is illustrated in FIG. 2, it should be understood that the bobbin may comprise a series of extensions, such as 2, 3 or 4 extensions arranged circumferentially around the bobbin. Finally, drive section 102 includes a support or partition 120 which aids in supporting the permanent magnets and core, and in separating the drive section from the pump section. It should be noted, however, that in the illustrated embodiment, the inner volume of the drive section, including the volume in which the coil is disposed, may be flooded with fluid during operation, such as for cooling purposes.

A drive member 122 is secured to bobbin 114 via extension 118. In the illustrated embodiment, drive member 122 forms a generally cup-shaped plate having a central aperture for the passage of fluid. The cup shape of the drive member aids in centering a plunger 124 which is disposed within a concave portion of the drive member. Plunger 124 preferably has a longitudinal central opening or aperture 126 extending from its base to a head region 128 designed to contact and bear against drive member 122. A biasing spring 130 is compressed between the head region 128 and a lower component of the pump section to maintain the plunger 124, the drive member 122, and bobbin and coil assembly in an upward or biased position. As will be appreciated by those skilled in the art, plunger 124, drive member 122, extension 118, bobbin 114, and coil 116 thus form a reciprocating assembly which is driven in an oscillating motion during operation of the device as described more fully below.

The drive section 102 and pump section 104 are designed to interface with one another, preferably to permit separate manufacturing and installation of these components as sub-assemblies, and to permit their servicing as needed. In the illustrated embodiment, housing 106 of drive section 102 terminates in a skirt 132 which is secured about a peripheral wall 134 of pump section 104. The drive and pump sections are preferably sealed, such as via a soft seal 136. Alternatively, these housings may be interfaced via threaded engagement, or any other suitable technique.

Pump section 104 forms a central aperture 138 designed to receive plunger 124. Aperture 138 also serves to guide the plunger in its reciprocating motion during operation of the device. An annular recess 140 surrounds aperture 138 and receives biasing spring 130, maintaining the biasing spring in a centralized position to further aid in guiding plunger 124. In the illustrated embodiment, head region 128 includes a peripheral groove or recess 142 which receives biasing spring 130 at an end thereof opposite recess 140.

A valve member 144 is positioned in pump section 104 below plunger 124. In the illustrated embodiment, valve member 144 forms a separable extension of plunger 124 during operation, but is spaced from plunger 124 by a gap 146 when plunger 124 is retracted as illustrated in FIG. 2. Gap 146 is formed by limiting the upward movement of valve member 144, such as by a restriction in the peripheral wall defining aperture 138. Grooves (not shown) may be provided at this location to allow for the flow of fluid around valve member 144 when the plunger is advanced to its retracted position. As described more fully below, gap 146 permits the entire reciprocating assembly, including plunger 124, to gain momentum during a pumping stroke before contacting valve member 144 to compress and expel fluid from the pump section.

Valve member 144 is positioned within a pump chamber 148. Pump chamber 148 receives fluid from an inlet 150. Inlet 150 thus includes a fluid passage 152 through which fluid, such as pressurized fuel, is introduced into the pump chamber. A check valve assembly, indicated generally at reference numeral 154, is provided between passage 152 and pump chamber 148, and is closed by the pressure created within pump chamber 148 during a pumping stroke of the device. In the illustrated embodiment, a fluid passage 156 is provided between inlet passage 152 and the volume within which the drive section components are disposed. Passage 156 may permit the free flow of fluid into the drive section, to maintain the drive section components bathed in fluid. A fluid outlet (not shown) may similarly be in fluid communication with the internal volume of the drive section, to permit the recirculation of fluid from the drive section.

Valve 144 is maintained in a biased position toward gap 146 by a biasing spring 158. In the illustrated embodiment, biasing spring 158 is compressed between an upper portion of the valve member and a retaining ring 160.

When the pump defined by the components described above is employed for direct fuel injection, as one exemplary utilization, a nozzle assembly 162 may be incorporated directly into a lower portion of the pump assembly. As shown in FIG. 2, an exemplary nozzle includes a nozzle body 164 which is sealingly fitted to the pump section. A poppet 166 is positioned within a central aperture formed in the valve body, and is sealed against the valve body in a retracted position shown in FIG. 2. At an upper end of poppet 166, a retaining member 168 is provided. Retaining member 168 contacts a biasing spring 170 which is compressed between the nozzle body and the retaining member to maintain the poppet in a biased, sealed position within the nozzle body. Fluid is free to pass from pump chamber 148 into the region surrounding the retaining member 168 and spring 170. This fluid is further permitted to enter into passages 172 formed in the nozzle body around poppet 166. An elongated annular flow path 174 extends from passages 172 to the sealed end of the poppet. As will be appreciated by those skilled in the art, other components may be incorporated into the pump, the nozzle, or the drive section. For example, where desired, an outlet check valve may be positioned at the exit of pump chamber 148 to isolate a downstream region from the pump chamber.

FIG. 3 illustrates the pump and nozzle assembly of FIG. 2 in an actuated position. As shown in FIG. 3, upon application of energizing current to the coil 116, the coil, bobbin 114, extension 118, and drive member 122 are displaced downwardly. This downward displacement is the result of interaction between the electromagnetic field surrounding coil 116 by application of the energizing current thereto, and the magnetic field present by virtue of permanent magnets 108 and 110. In the preferred embodiment, this magnetic field is reinforced and channeled by core 112. As drive member 122 is forced downwardly by interaction of these fields, it contacts plunger 124 to force the plunger downwardly against the resistance of spring 130. During an initial phase of this displacement, plunger 124 is free to extend into pump chamber 148 without contact with valve member 144, by virtue of gap 146 (see FIG. 2). Plunger 124 thus gains momentum, and eventually contacts the upper surface of valve member 144. The lower surface of plunger 124 seats against and seals with the upper surface of valve member 144, to prevent flow of fluid upwardly through passage 126 of the plunger, or between the plunger and aperture 138 of the pump section. Further downward movement of the plunger 124 and valve member 144 begin to compress fluid within pump chamber 148, closing inlet check valve 154.

Still further movement of the plunger and valve member thus produces a pressure surge or spike which is transmitted downstream, such as to nozzle assembly 162. In the illustrated embodiment, this pressure surge forces poppet 166 to unseat from the nozzle body, moving downwardly with respect to the nozzle body by a compression of spring 170 between retainer 168 and the nozzle body. Fluid, such as fuel, is thus sprayed or released from the nozzle, such as directly into a combustion chamber of an internal combustion engine as described above with reference to FIG. 1.

As will be appreciated by those skilled in the art, upon reversal of the polarity of the drive or control signal applied to coil 116, an electromagnetic field surrounding the coil will reverse in orientation, causing an oppositely oriented force to be exerted on the coil by virtue of interaction between this field and the magnetic field produced by magnets 108 and 110. This force will thus drive the coil, and other components of the reciprocating assembly back toward their original position. In the illustrated embodiment, as drive member 122 is driven upwardly back towards the position illustrated in FIG. 1, spring 130 urges plunger 124 upwardly towards its original position, and spring 158 similarly urges valve member 144 back towards its original position. Gap 126 is reestablished as illustrated in FIG. 1, and a new pumping cycle may begin. Where a nozzle such as that shown in FIGS. 2 and 3 is provided, the nozzle is similarly closed by the force of spring 170. In this case, as well as where no such nozzle is provided, or where an outlet check valve is provided at the exit of pump chamber 148, pressure is reduced within pump chamber 148 to permit inlet check valve 154 to reopen for introduction of fluid for a subsequent pumping cycle.

By appropriately configuring drive signals applied to coil 116, the device of the present invention may be driven in a wide variety of manners. For example, in a conventional pumping application, shaped alternating polarity signals may be applied to the coil to cause reciprocating movement at a frequency equal to the frequency of the control signals. Displacement of the pump, and the displacement per cycle, may thus be controlled by appropriately configuring the control signals (i.e. altering their frequency and duration). Pressure variations may also be accommodated in the device, such as to conform to output pressure needs. This may be accomplished by altering the amplitude of the control signals to provide greater or lesser force by virtue of the interaction of the resulting electromagnetic field and the magnetic field of the permanent magnets in the drive section.

Figure 4:
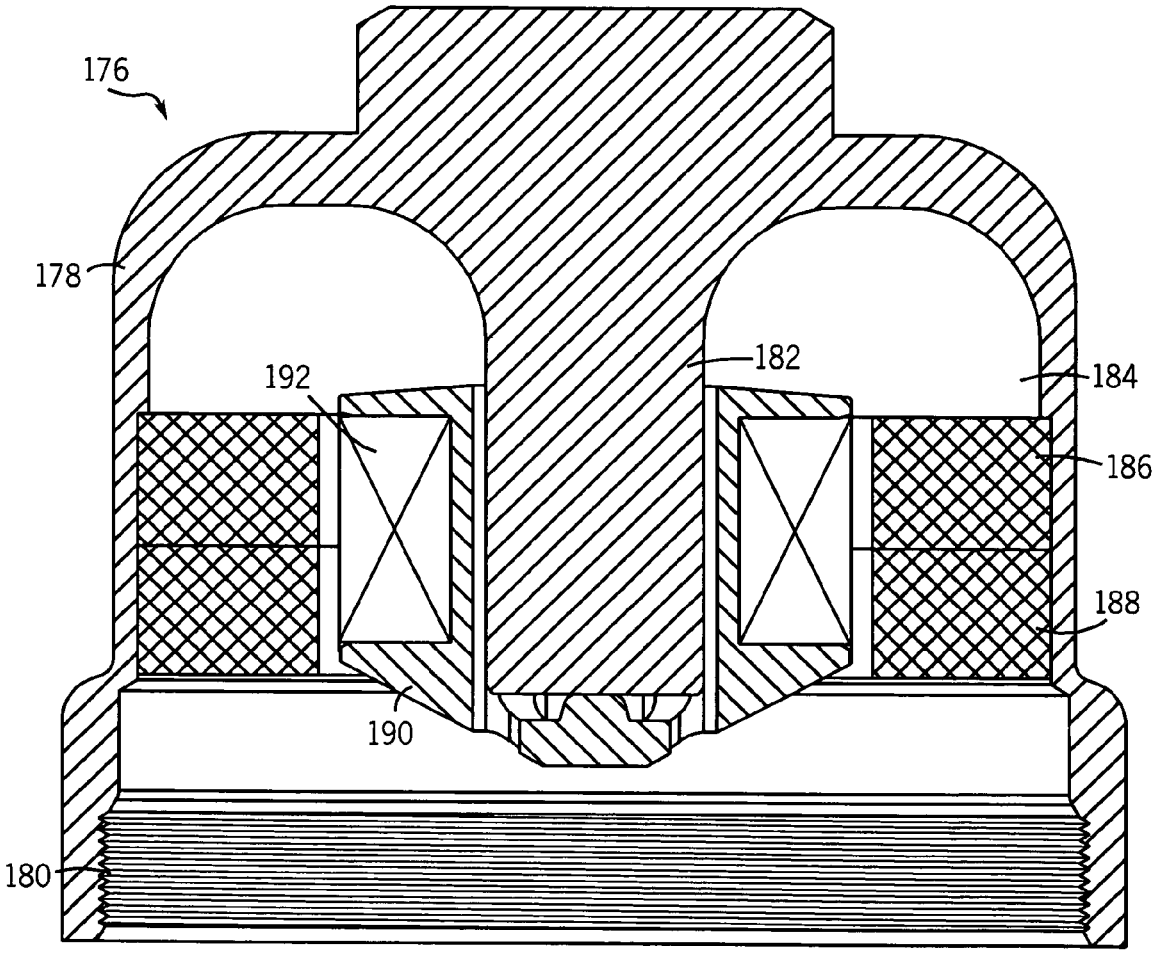
FIG. 4 is a partial sectional view of an alternative embodiment of a drive section of a fluid pump in accordance with aspects of the present technique.
Figure 5:
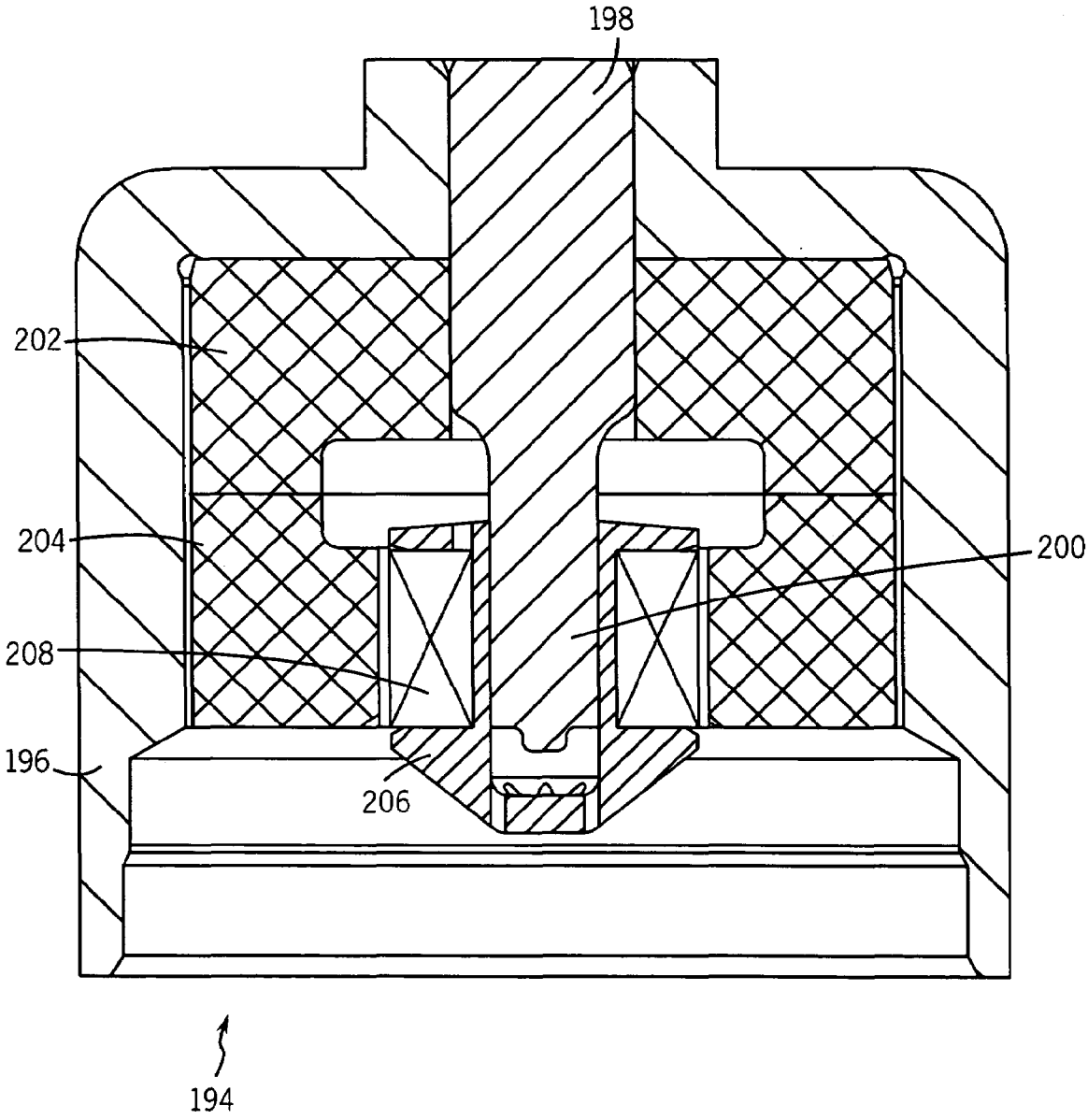
FIG. 5 is a partial sectional view of a further alternative embodiment of a pump drive section.

The foregoing structure may be subject to a variety of adaptations and alterations, particularly in the configuration of the coil, bobbin, permanent magnet structures, and drive components of the drive section. Two such alternative configurations of the drive section are illustrated in FIGS. 4 and 5. As shown in FIG. 4, in a first alternative drive section 176, a bell-shaped housing 178 has a lower threaded region 180 designed to be fitted about a similar threaded region of a pump section. Moreover, in the embodiment of FIG. 4, a central core portion 182 is formed in the housing to channel magnetic flux. An inner annular volume 184 surrounds core portion 182 and supports one or more permanent magnets 186 and 188. These annular magnets surround a bobbin 190 which is supported for reciprocal guided movement along core portion 182. A coil 192 is wound on bobbin 190 and receives reversing polarity control signals via leads (not shown) as described above with reference to FIGS. 2 and 3. A lower portion of bobbin 190 may thus interface directly with a plunger (see plunger 124 of FIGS. 2 and 3) appropriately configured to remain centered with respect to the bobbin. During application of the reversing polarity control signals, an electromagnetic field is produced around coil 192 which interacts with the magnetic field created by magnets 186 and 188 to drive the coil and bobbin in reciprocating movement along core portion 182. This reciprocating movement is then translated into a pumping action through components such as those described above with reference to FIGS. 2 and 3.

In the alternative embodiment of FIG. 5, designated generally by reference numeral 194, a guide post or pin 198 is positioned within the pump section housing 196. The housing 196 may be made of a different material than post 198. Post 198 may preferably be formed of a magnetic material, such as a ferromagnetic material, such that the post forms a core for channeling flux at least within a central region 200. One or more permanent magnets 202 and 204 are provided for producing a magnetic flux field which is thus channeled by the core. A bobbin 206, similar to bobbin 190, as shown in FIG. 4, is fitted and guided along central region 200. A coil 208 is wound on bobbin 206, and receives reversing polarity control signals during operation of the device. As before, the electromagnetic field resulting from application of the control signals interacts with the magnetic field produced by magnets 102 and 104, to drive the coil and bobbin in reciprocating motion which is translated to pumping action by pumping components such as those described above with reference to FIGS. 2 and 3.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A fuel injector for spraying fuel into a cylinder of an internal combustion engine, comprising:

a first end;

a second end;

at least one permanent magnet fixedly attached to the first end;

a coil bobbin disposed about the at least one permanent magnet and being reciprocally movable between a first position near the first end and a second position towards the second end;

a coil wound on the bobbin;

a plunger operatively connected to the coil bobbin and disposed between the at least one permanent magnet and the second end;

a first biasing spring for biasing the plunger and the coil bobbin towards the first end, the first biasing spring being disposed between the coil bobbin and the second end;

a pump chamber for receiving fuel disposed between the plunger and the second end;

a first passage for introducing fuel into the pump chamber;

a second passage at the second end being in fluid communication with the pump chamber;

a poppet disposed in the second passage being movable between an open position and a sealed position; and a second biasing spring for biasing the poppet towards the sealed position, movement of the coil bobbin towards the second position thereof causing movement of the plunger towards the second end, movement of the plunger towards the second end pressurizing fuel in the pump chamber, the poppet moving to its open position once fuel pressure in the pump chamber is high enough to overcome the bias of the second biasing spring.

2. The fuel injector of claim 1, wherein the at least one permanent magnet comprises a pair of permanent magnets.

3. The fuel injector of claim 2, further comprising:

a central core made of a material that is capable of conducting magnetic flux, the central core separating the pair of permanent magnets and disposed adjacent thereto.

4. The fuel injector of claim 1, further comprising a check valve disposed in the first passage.

5. The fuel injector of claim 1, wherein the pump chamber has a side wall, the first passage introducing fuel in the fuel chamber via an opening in the side wall of the pump chamber.

6. A fuel injector for spraying fuel into a cylinder of an internal combustion engine, comprising:

a drive section having:

a housing; at least one permanent magnet fixedly supported within the housing;

a coil bobbin slidable with respect to the at least one permanent magnet between a first position and a second position away from the at least one magnet;

a coil wound on the bobbin, the coil having free ends for receiving energizing control signals;

a plunger operatively connected to the coil bobbin such that movement of the coil bobbin in one direction causes movement of the plunger in the same direction; and a first biasing spring for biasing the plunger and the coil bobbin towards the first position;

a pump section having a first end and a second end, the first end of the pump section being secured to the drive section, the pump section also having:

a central aperture for receiving a portion of the plunger of the drive section;

a pump chamber adjacent to the central aperture for receiving fuel; and a first fluid passage for introducing fuel into the pump chamber; and a nozzle assembly having:

a nozzle body fitted to the second end of the pump section and having a central aperture;

a poppet positioned in the central aperture of the nozzle body, the poppet being movable between an open position and a sealed position; and a second biasing spring for biasing the poppet towards the sealed position.

7. The fuel injector of claim 6, wherein the at least one permanent magnet comprises a pair of permanent magnets.

8. The fuel injector of claim 7, further comprising:

a central core made of a material that is capable of conducting magnetic flux, the central core separating the pair of permanent magnets and disposed adjacent thereto.

9. The fuel injector of claim 6, further comprising a partition separating the drive section from the pump section.

10. The fuel injector of claim 6, wherein the housing has a skirt secured about a peripheral wall of the pump section.

11. The fuel injector of claim 10, further comprising a seal located between the skirt and the peripheral wall.

12. The fuel injector of claim 6, further comprising a check valve disposed in the first fluid passage.

13. The fuel injector of claim 6, wherein the pump chamber has a side wall, the first fluid passage introducing fuel in the fuel chamber via an opening in the side wall of the pump chamber.

14. The fuel injector of claim 6, further comprising a second fluid passage extending from the first fluid passage to a volume defined by the housing of the drive section.

15. A fuel injector for spraying fuel into a cylinder of an internal combustion engine, comprising:

a housing;

at least one permanent magnet fixedly attached to a portion of the housing;

a coil bobbin disposed about the at least one permanent magnet and being reciprocally movable relative thereto;

a coil wound on the bobbin;

a drive member secured to the coil bobbin;

a plunger received within a central aperture, the plunger having a head region designed to contact the drive member so as to reciprocate with the coil bobbin;

a first biasing spring for biasing the plunger, the drive member, and the coil bobbin towards the portion of the housing to which the at least one permanent magnet is attached;

a pump chamber adjacent to the central aperture for receiving fuel;

a valve member positioned in the pump chamber and being reciprocally movable therein by interacting with the plunger;

a first passage for introducing fuel in the pump chamber;

a second biasing spring for biasing the valve member towards the plunger;

a second passage in fluid communication with the pump chamber;

a poppet disposed in the second passage, the poppet being movable between an open position and a sealed position; and a third biasing spring for biasing the poppet towards the sealed position.

16. The fuel injector of claim 15, wherein the at least one permanent magnet comprises a pair of permanent magnets.

17. The fuel injector of claim 16, further comprising:

a central core made of a material that is capable of conducting magnetic flux, the central core separating the pair of permanent magnets and disposed adjacent thereto.

18. The fuel injector of claim 15, wherein the plunger has a longitudinal central aperture.

19. The fuel injector of claim 15, wherein a gap is created between the plunger and the valve member during at least a portion of the movement of the coil bobbin.

20. The fuel injector of claim 15, further comprising a third passage extending from the first passage to a volume defined by the housing.

21. A fuel injector for spraying fuel into a cylinder of an internal combustion engine, comprising:

a drive section having:

a housing;

at least one permanent magnet fixedly supported within the housing;

a coil bobbin slidable with respect to the at least one permanent magnet between a first position and a second position away from the at least one magnet;

a coil wound on the bobbin, the coil having free ends for receiving sequentially a first signal having a first polarity and a first amplitude to control movement of the coil bobbin towards the second position, and a second signal having a second polarity opposite to the first polarity and a second amplitude to control movement of the coil bobbin towards the first position, the first and second signal being generated by a controller and being independently alterable as a function of engine demand;

a plunger operatively connected to the coil bobbin such that movement of the coil bobbin in one direction causes movement of the plunger in the same direction; and a first biasing spring for biasing the plunger and the coil bobbin towards the first position;

a pump section having a first end, a second end, and a pump chamber therein for receiving fuel, the first end of the pump section being secured to the drive section; and a nozzle assembly having:

a nozzle body fitted to the second end of the pump section and having a central aperture; and a poppet positioned in the central aperture of the nozzle body.

22. The fuel injector of claim 21, wherein the at least one permanent magnet comprises a pair of permanent magnets.

23. The fuel injector of claim 22, further comprising:

a central core made of a material that is capable of conducting magnetic flux, the central core separating the pair of permanent magnets and disposed adjacent thereto.

24. The fuel injector of claim 21, further comprising a partition separating the drive section from the pump section.

25. The fuel injector of claim 21, wherein the housing has a skirt secured about a peripheral wall of the pump section.

26. The fuel injector of claim 25, further comprising a seal located between the skirt and the peripheral wall.

27. The fuel injector of claim 21, further comprising a first fluid passage for introducing fuel into the pump chamber.

28. The fuel injector of claim 27, further comprising a check valve disposed in the first fluid passage.

29. The fuel injector of claim 27, wherein the pump chamber has a side wall, the first fluid passage introducing fuel in the fuel chamber via an opening in the side wall of the pump chamber.

30. The fuel injector of claim 27, further comprising a second fluid passage extending from the first fluid passage to a volume defined by the housing of the drive section.

* * * * *